US006255257B1

(12) United States Patent
Yamada et al.

(10) Patent No.: US 6,255,257 B1
(45) Date of Patent: Jul. 3, 2001

(54) SILICONE GREASE COMPOSITION

(75) Inventors: Kunihiro Yamada; Takayuki Takahashi; Kenichi Isobe, all of Gunma-ken (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/453,469

(22) Filed: Dec. 2, 1999

(30) Foreign Application Priority Data

Dec. 2, 1998 (JP) ..... 10-343037

(51) Int. Cl.[7] ..... C10M 107/50; C10M 113/08

(52) U.S. Cl. ..... 508/172; 508/155; 508/161; 508/208

(58) Field of Search ..... 508/172, 208

(56) References Cited

U.S. PATENT DOCUMENTS 4,265,775 * 5/1981 Aakalu et al. ..... 252/573
5,100,568 * 3/1992 Takahashi et al. ..... 252/28
5,227,081 * 7/1993 Sawa et al. ..... 252/28
5,981,641 * 11/1999 Takahashi et al. ..... 524/428
6,015,777 * 1/2000 Lostritto, Jr. et al. ..... 508/208
6,114,429 * 9/2000 Yamada et al. ..... 524/423

* cited by examiner

*Primary Examiner*—Ellen M. McAvoy
(74) *Attorney, Agent, or Firm*—Millen White Zelano & Branigan

(57) ABSTRACT

A silicone grease composition having high thermal conductivity, comprising (A) 50 to 95 weight % of a mixture of an aluminum nitride powder α having an average particle size of 0.5 to 5 μm and an aluminum nitride powder β having an average particle size of 6 to 20 μm, wherein the aluminum nitride powders α and β are mixed so that the α/(α+β) ratio by weight is from 0.1 to 0.9 and the average particle size after mixing is from 1 to 10 μm, (B) 5 to 15 weight % of organopolysiloxanes having a viscosity of from 50 to 50,000 cs at 25° C. and represented by formula $R^1{}_aSiO_{(4-a)/2}$, wherein $R^1$ represents at least one group selected from saturated or unsaturated univalent hydrocarbon groups containing 1 to 18 carbon atoms and $1.8 \leqq a \leqq 2.2$, and (C) 0 to 35 weight % of at least one inorganic compound powder having an average particle size of 0.5 to 100 μm selected from the group consisting of zinc oxide, alumina, boron nitride and silicon carbide powders.

17 Claims, No Drawings

SILICONE GREASE COMPOSITION

FIELD OF THE INVENTION

The present invention relates to a silicone grease composition having excellent thermal conductivity.

BACKGROUND OF THE INVENTION

Most of electronic parts generate heat during the operation, and so the heat removal therefrom is required for making them function properly. As to heat-reducing materials applicable to electronic parts, there are high expectations for aluminum nitride because of its high thermal conductivity and electric insulation. The aluminum nitride can be used in various forms, e.g., as a molding and a powder for the filler of grease or rubber.

For achieving high thermal conductivity by the use of aluminum nitride powder as the filler of grease or rubber, it is necessary to raise the filling rate of the aluminum nitride powder. In the case of grease, therefore, the use of a wetter or the art of using as a base oil a modified oil having good wettability has so far been proposed as a solution for raising the filling rate. However, both proposals have failed in achieving satisfactorily high filling rate of aluminum nitride to result in being unsuccessful at obtaining high thermal conductivity.

SUMMARY OF THE INVENTION

As a result of our intensive study of the problem of raising thermal conductivity by increasing the filling rate of aluminum nitride in silicone grease, it has been found that a very good result can be obtained when the filler used is a mixture of two kinds of aluminum nitride powders differing in average particle size, thereby achieving the present invention.

Therefore, an object of the invention is to provide a silicone grease composition having especially high thermal conductivity.

The aforementioned object of the invention is attained with a silicone grease composition comprising the following components (A) to (C):

(A) 50 to 95 weight % of a mixture of an aluminum nitride powder α having an average particle size of 0.5 to 5 μm and an aluminum nitride powder β having an average particle size of 6 to 20 μm, wherein the aluminum nitride powders α and β are mixed so that the α/(α+β) ratio is from 0.1 to 0.9 by weight and the average particle size after mixing is from 1 to 10 μm, (B) 5 to 15 weight % of organopolysiloxanes having a viscosity of from 50 to 50,000 cs at 25° C. and represented by formula $R^1_aSiO_{(4-a)/2}$, wherein $R^1$ represents at least one group selected from saturated or unsaturated univalent hydrocarbon groups containing 1 to 18 carbon atoms and $1.8 \leqq a \leqq 2.2$, and (C) 0 to 35 weight % of at least one inorganic compound powder having an average particle size of 0.5 to 100 μm selected from the group consisting of zinc oxide, alumina, boron nitride and silicon carbide powders.

DETAILED DESCRIPTION OF THE INVENTION

The aluminum nitride as the present Component (A) is obtained by mixing two kinds of aluminum nitride powders, namely aluminum nitride powders α and β differing in average particle size. The grease composition can have an increased filling rate by the combined use of the foregoing fillers, compared with an individual use of either filler; as a result, the thermal conductivity of the grease can be improved. The thermal conductivity value the grease composition can acquire by the combined use of the foregoing fillers is higher than that by the use of each of the fillers in the greatest possible filling amount. Further, the consistency the composition can have in the former case is higher (in other words, the composition can be more softened) than that in the latter case, so that the present composition has the advantage of handling easily.

The aluminum nitride powder a as one constituent of Component (A) is required to have an average particle size in the range of 0.5 to 5 μm. This is because the filling rate of the thermal conductive silicone grease composition cannot be raised so far as the average particle size of aluminum nitride powder α is smaller than 0.5 μm or greater than 5 μm. In particular, it is desirable that the average particle size of the aluminum nitride powder α be from 1 to 3 μm. In analogy with the aluminum nitride powder α, the aluminum nitride powder β as the other constituent of Component (A) cannot contribute to raising the filling rate of a thermal conductive silicone grease composition so far as it has an average particle size smaller than 6 μm or greater than 20 μm. Therefore, the average particle size of aluminum nitride powder β is required to be from 6 to 20 μm. In particular, it is desirable that the aluminum nitride powder β have an average particle size in the range of 7 to 15 μm.

In mixing the aluminum nitride powders α and β, the ratio α/(α+β) is required to be in the range of 0.1 to 0.9 by weight, because the filling rate in the resulting thermal conductive silicone grease composition cannot be increased when the ratio α/(α+β) is smaller than 0.1 or greater than 0.9 by weight. In particular, it is desirable for the ratio α/(α+β) to be from 0.3 to 0.7 by weight. Moreover, the aluminum nitride powders thus mixed is required to have an average particle size of from 1 to 10 μm, because no homogeneous grease composition can be obtained so far as the average particle size is smaller than 1 μm or greater than 10 μm. When the average particle size is from 2 to 5 μm, better results can be obtained.

The total proportion of aluminum nitride powders α and β in the silicone grease composition is required to be from 50 to 95 weight %. This is because the grease composition obtained cannot have satisfactory thermal conductivity when the total proportion is lower than 50 weight %, while it becomes hard and poor in speadability when the total proportion is higher than 95 weight %. The preferred range of the total proportion is from 60 to 90 weight %.

The powders of aluminum nitride usable in the invention are those of nitride constituted of Group III and Group V elements and generally having a hexagonal or wurtzite-type crystal structure and a white or grayish white appearance. The particle shape thereof is amorphous or spherical depending on the preparation method adopted.

The aluminum nitride powder usable as a raw material can be prepared, e.g., by a direct nitriding method wherein metallic aluminum powder is reacted directly with nitrogen or ammonia, an alumina reducing method wherein a mixed powder of alumina and carbon is heated in an atmosphere of nitrogen or ammonia to effect the reduction and the nitriding at the same time, a method of reacting an aluminum vapor directly with nitrogen, or a method of thermally decomposing $AlCl_3 \cdot NH_3$.

In order to obtain aluminum nitride powders having the intended particle sizes, the coarse powder prepared using the method as recited above is ground with a vibration mill or a jet mill. In this step, the aluminum nitride powders α and β used in the invention can be obtained by properly choosing the grinding time. Further, airflow classification may be carried out after grinding step.

When the aluminum nitride powders α and β have their individual specific surface areas in the range of 0.1 to $20^2$/g, they will serve the purpose of preparing a homogeneous grease composition. And it is desirable for the mixture of the aluminum nitride powders α and β to have its specific surface area in the range of 0.1–20 $m^2$/g, preferably 1–10 $m^2$/g, particularly preferably 2–5 $m^2$/g. These values of the specific surface area are those determined according to JIS K1150.

Although the characteristics of aluminum nitride powders, including the chemical composition (impurities), the particle shape and the particle size distribution, depend on the methods employed for preparing them, the present aluminum nitride powders may be prepared by any of the preparation methods as mentioned above, and they each may be a mixture of powders prepared by different methods.

In addition, if desired, the surface of the present aluminum nitride powders may be rendered hydrophobic by undergoing treatment with organosilanes, organopolysiloxanes or fluorine-containing organic compounds.

The treatment for imparting hydrophobicity to the aluminum nitride powder surface may be carried out in a conventional way. For instance, the aluminum nitride powders and an organosilane or partial hydrolysis products thereof are mixed by means of a mixing machine, such as TRIMIX, TWINMIX or PLANETARY MIXER (trade names, made by INOUE MFG., INC.), ULTRA MIXER (trade name, made by MIZUHO INDUSTRIAL CO., LTD.) or HIVIS-DISPERMIX (trade name, made by TOKUSHU KIKA KOGYO CO., LTD.). Therein, the mixing system may be heated to a temperature of 50–150° C., if desired.

Therein, they may be mixed in the presence of a solvent, such as toluene, xylene, petroleum ether, mineral spirit, isoparaffin, isopropyl alcohol or ethanol. After mixing, however, it is desirable that the solvent be removed with, e.g., a vacuum apparatus.

On the other hand, it is possible to use as a diluting solvent a liquid organopolysiloxane as Component (B) of the present composition. In this case, the organopolysiloxane or its partial hydrolysis products used as the treatment agent is mixed previously with the organopolysiloxane used as Component (B), and thereto aluminum nitride powders are added. Thereby, the treatment and the mixing can be carried out at the same time. The composition prepared in such a manner is also included in the scope of the invention.

In the formula $R^1{}_aSiO_{(4-a)/2}$ representing organopolysiloxanes used as Component (B) , $R^1$ is at least one group selected from saturated or unsaturated univalent hydrocarbon groups containing 1 to 18 carbon atoms. Examples of such a hydrocarbon group include an alkyl group, such as methyl, ethyl, propyl, hexyl, octyl, decyl, dodecyl, tetradecyl or octadecyl; a cycloalkyl group, such as cyclopentyl or cyclohexyl; an alkenyl group, such as vinyl or allyl; an aryl group, such as phenyl or tollyl; an aralkyl group, such as 2-phenylethyl or 2-methyl-2-phenylethyl; and a halogenated hydrocarbon group, such as 3,3,3-trifluoropropyl, 2-(perfluorobutyl)ethyl, 2-(perfluorooctyl)ethyl or p-chlorophenyl. In particular, methyl group, phenyl group and alkyl groups containing 6 to 14 carbon atoms are preferred as $R^1$ in the invention.

In view of the consistency required for the silicone grease composition, it is desirable that the suffix "a" in the foregoing formula be a number ranging from 1.8 to 2.2, particualrly 1.9 to 2.1. Further, it is required for the organopolysiloxanes used in the invention to have their viscosity in the range of 50 to 500,000 cs at 25° C. This is because the grease composition shows a tendency to oil bleeding when it comprises the organopolysiloxanes having viscosity lower than 50 cs at 25° C.; while, when it comprises organopolysiloxanes having viscosity higher than 500,000 cs at 25° C., the grease composition has poor spreadability. In particular, it is advantageous to use organopolysiloxanes having their viscosity in the range of 100 to 10,000 cs at 25° C. Additionally, the viscosity measurement in the invention was made according to JIS K2283.

The proportion of organopolysiloxanes used as Component (B) in the present grease composition is required to be from 5 to 15 weight %. In particular, more desirable results are obtained when the proportion ranges from 7 to13 weight %. This is because when the organopolysiloxanes are used in a proportion lower than 5 weight % the composition obtained becomes hard and has poor spreadability; while when they are used in a proportion higher than 15 weight % the composition obtained has insufficient thermal conductivity.

The inorganic compound powder usable as Component (C) is a powder of at least one inorganic compound having high thermal conductivity that is selected from the group consisting of zinc oxide, alumina, boron nitride and silicon carbide. The surface of such an inorganic powder may be rendered hydrophobic by treatment with an organosilane, organosilazane, organopolysiloxane or organic fluorine-containing compound, if desired.

The average particle size of the inorganic compound powder as Component (C) is required to be in the range of 0.5 to 100 μm, because the filling rate of Component (C) in the present grease composition cannot be raised as far as the inorganic compound powder has an average particle size smaller than 0.5 μm or greater than 100 μm. Further, the inorganic compound powder is required to be contained in the present grease composition in a proportion of at most 30 weight %, because when the proportion thereof is increased beyond 30 weight % the resulting composition comes to have poor thermal conductivity. Further, it is advantageous to the present grease composition that the proportion of inorganic compound powder be from 0 to 25 weight %.

In preparing a silicone grease composition according to the invention, the aforementioned Components (A) to (C) are mixed together by means of a mixing machine, e.g., TRIMIX, TWINMIX or PLANETARY MIXER (trade names, made by INOUE MFG., INC.), ULTRA MIXER (trade name, made by MIZUHO INDUSTRIAL CO., LTD.) or HIVISDISPERMIX (trade name, made by TOKUSHU KIKA KOGYO CO., LTD.). Therein, the mixing system may be heated to a temperature of 50–150° C., if needed. For rendering the thus prepared mixture more homogeneous, it is desirable to perform a kneading operation under high shear stress. Examples of a kneader usable for such an operation include a three-rod roll kneader, a colloid mill and a sand grinder. Of these kneaders, a three-rod roll kneader is used to advantage.

In accordance with embodiments of the invention, there is a big rise in the thermal conductivity of silicone grease composition. Therefore, the present silicone grease composition is well suited for use as thermal conductive silicone grease for removing heat from exothermic electronic parts.

Now, the invention will be illustrated in greater detail by reference to the following Examples, but these examples should not be construed as limiting the scope of the invention.

The entire disclosure of all applications, patents and publications, cited above and below, and of corresponding Japanese application No. Hei 10-343037, filed, Dec. 2, 1998, is hereby incorporated by reference.

Additionally, the consistency measurement in each of Examples and Comparative Examples is made according to the method defined in JIS K-2220, and the thermal conductivity of each grease composition prepared is measured at 25° C. with a quick thermal conductivity meter, QTM-500 (trade name, made by KYOTO ELECTRONICS MFG. CO., LTD.). The particle size measurements are made with a Granulometer HR850 (trade name, made by Cilas Alcatel Inc.). The viscosities of organopolysiloxanes used in Examples are values measured at 25° C.

Further, the criteria employed for evaluating the appearance and the spreadability of each grease composition prepared are described below.

Appearance Evaluation

The surface condition of each grease composition is evaluated by visual observation as follows;

○:The grease composition surface is uniform and smooth.

Δ:The grease composition surface is somewhat nonuniform.

X:The grease composition surface is nonuniform

Speadability Evaluation

Each grease composition in an amount of 0.2 g is put on an aluminum plate, and spread with a finger. And the spreading condition of the grease composition is evaluated as follows;

○:The grease composition is spread smoothly.

Δ:The grease composition is spread rather poorly and gives a rough feeling.

X:The grease composition is spread poorly.

PREPARATION EXAMPLE 1

In a PLANETARY MIXER (trade name, made by INOUE MFG., INC.) having a volume of 5 liter, 500 g of an aluminum nitride powder (A-1). having an average particle size of 1.5 μm and 500 g of an aliminum nitride powder (A-3) having an average particle size of 8.0 μm were thrown, and stirred for 30 minutes at room temperature to prepare a mixed aluminum nitride powder (D-1). The average particle size of the mixed aluminum nitride powder (D-1) was determined to be 3.4 μm.

PREPARATION EXAMPLES 2 TO 12

Mixed aluminum nitride powders (D-2) to (D-12) were each prepared in the same manner as in Preparation Example 1, except that aluminum nitride powders having different average particle sizes were paired with each other as shown in Table 1 and mixed in the weights (in grams) as set forth in Table 1. The average particle sizes of the mixed aluminum powders (D-2) to (D-12) thus prepared are also shown in Table 1.

TABLE 1

| Aluminum nitride powder | Mixed aluminum nitride powder | | | | | | | | | | |
|---|---|---|---|---|---|---|---|---|---|---|---|
| | D-2 | D-3 | D-4 | D-5 | D-6 | D-7 | D-8 | D-9 | D-10 | D-11 | D-12 |
| A-1 | 0 | 500 | 0 | 400 | 0 | 400 | 0 | 700 | 0 | 0 | 500 |
| A-2 | 500 | 0 | 500 | 0 | 400 | 0 | 400 | 0 | 700 | 0 | 0 |
| A-3 | 0 | 0 | 500 | 600 | 0 | 0 | 600 | 300 | 0 | 500 | 0 |
| A-4 | 500 | 500 | 0 | 0 | 600 | 600 | 0 | 0 | 300 | 0 | 0 |
| A-5 | 0 | 0 | 0 | 0 | 0 | 0 | 0 | 0 | 0 | 500 | 0 |
| A-6 | 0 | 0 | 0 | 0 | 0 | 0 | 0 | 0 | 0 | 0 | 500 |
| Average particle size (μm) after mixing | 4.4 | 3.9 | 3.6 | 3.8 | 4.6 | 4.1 | 3.7 | 2.7 | 3.6 | 2.9 | 4.6 |

The symbols A-1 to A-6 used in Table 1 stand for the following;

A-1; Aluminum nitride powder (average particle size: 1.5 μm, crystal shape: amorphous)

A-2; Aluminum nitride powder (average particle size: 2.5 μm, crystal shape: amorphous)

A-3; Aluminum nitride powder (average particle size: 8.0 μm, crystal shape: amorphous)

A-4; Aluminum nitride powder (average particle size: 12.5 μm, crystal shape: amorphous)

A-5; Aluminum nitride powder (average particle size: 0.4 μm, crystal shape: amorphous)

A-6; Aluminum nitride powder (average particle size: 25 μm, crystal shape: amorphous)

EXAMPLES 1 TO 10 AND COMPARATIVE EXAMPLES 1 TO 8

Silicone grease composition samples according to the invention (Examples 1–10) and those for comparison (Comparative Examples 1 to 8) were each prepared by weighing Components (A) to (C) in their respective amounts set forth in Table 2 and Table 3 respectively, mixing those components for 30 minutes at room temperature by means of a PLANETARY MIXER (trade name, made by INOUE MFG., INC.) having a volume of 5 liter, and then subjecting the resulting mixture to a kneading operation with a three-rod roll kneader three times. Each silicone grease thus prepared was examined for characteristics (such as appearance, speadability, consistency and thermal conductivity). The results obtained are shown in Tables 2 and 3.

Additionally, the symbols B-1, B-2, C-1 and C-2 used in Tables 2 and 3 represent the following ingredients:

B-1;

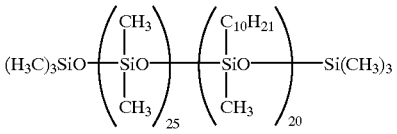

viscosity: 390 cs (25° C.)

B-2;

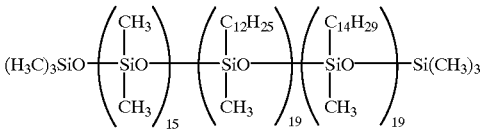

viscosity: 500 cs (25° C.)

C-1; Zinc oxide powder (average particle size: 2.0 $\mu$m, amorphous)

C-2; Alumina powder (average particle size: 15 $\mu$m, amorphous)

TABLE 2

| Component | Example 1 | 2 | 3 | 4 | 5 | 6 | 7 | 8 | 9 | 10 |
|---|---|---|---|---|---|---|---|---|---|---|
| Amount mixed (g) | | | | | | | | | | |
| Component (A) | | | | | | | | | | |
| D-1 | 700 | 0 | 0 | 0 | 0 | 0 | 0 | 0 | 0 | 0 |
| D-2 | 0 | 700 | 0 | 0 | 0 | 0 | 0 | 0 | 0 | 0 |
| D-3 | 0 | 0 | 700 | 0 | 0 | 0 | 0 | 0 | 0 | 0 |
| D-4 | 0 | 0 | 0 | 700 | 0 | 0 | 0 | 0 | 0 | 0 |
| D-5 | 0 | 0 | 0 | 0 | 700 | 0 | 0 | 0 | 0 | |
| D-6 | 0 | 0 | 0 | 0 | 0 | 700 | 0 | 0 | 0 | 0 |
| D-7 | 0 | 0 | 0 | 0 | 0 | 0 | 800 | 0 | 0 | 0 |
| D-8 | 0 | 0 | 0 | 0 | 0 | 0 | 0 | 800 | 0 | 0 |
| D-9 | 0 | 0 | 0 | 0 | 0 | 0 | 0 | 0 | 870 | 0 |
| D-10 | 0 | 0 | 0 | 0 | 0 | 0 | 0 | 0 | 0 | 870 |
| Component (B) | | | | | | | | | | |
| B-1 | 100 | 100 | 100 | 100 | 0 | 0 | 100 | 100 | 0 | 130 |
| B-2 | 0 | 0 | 0 | 0 | 120 | 120 | 0 | 0 | 130 | 0 |
| Component (C) | | | | | | | | | | |
| C-1 | 200 | 200 | 200 | 200 | 0 | 0 | 0 | 0 | 0 | 0 |
| C-2 | 0 | 0 | 0 | 0 | 80 | 80 | 100 | 100 | 0 | 0 |
| Appearance | ○ | ○ | ○ | ○ | ○ | ○ | ○ | ○ | ○ | ○ |
| Spreadability | ○ | ○ | ○ | ○ | ○ | ○ | ○ | ○ | ○ | ○ |
| Consistency | 310 | 305 | 295 | 303 | 330 | 325 | 295 | 300 | 345 | 338 |
| Thermal Conductivity (W/mk) | 2.9 | 2.8 | 2.8 | 2.9 | 2.7 | 2.7 | 2.9 | 2.8 | 3.0 | 3.0 |

TABLE 3

| Component | Comparative Example 1 | 2 | 3 | 4 | 5 | 6 | 7 | 8 |
|---|---|---|---|---|---|---|---|---|
| Amount mixed (g) | | | | | | | | |
| Component (A) | | | | | | | | |
| A-1 | 700 | 0 | 0 | 0 | 0 | 0 | 0 | 0 |

TABLE 3-continued

| Component | Comparative Example 1 | 2 | 3 | 4 | 5 | 6 | 7 | 8 |
|---|---|---|---|---|---|---|---|---|
| A-2 | 0 | 700 | 0 | 0 | 0 | 0 | 0 | 0 |
| A-3 | 0 | 0 | 700 | 0 | 0 | 0 | 0 | 0 |
| A-4 | 0 | 0 | 0 | 700 | 0 | 0 | 0 | 0 |
| A-5 | 0 | 0 | 0 | 0 | 700 | 0 | 0 | 0 |
| A-6 | 0 | 0 | 0 | 0 | 0 | 700 | 0 | 0 |
| D-11 | 0 | 0 | 0 | 0 | 0 | 0 | 700 | 0 |
| D-12 | 0 | 0 | 0 | 0 | 0 | 0 | 0 | 700 |
| Component (B) | | | | | | | | |
| B-1 | 100 | 100 | 100 | 100 | 100 | 100 | 100 | 100 |
| B-2 | 0 | 0 | 0 | 0 | 0 | 0 | 0 | 0 |
| Component (C) | | | | | | | | |
| C-1 | 200 | 200 | 200 | 200 | 200 | 200 | 200 | 200 |
| C-2 | 0 | 0 | 0 | 0 | 0 | 0 | 0 | 0 |
| Appearance | X | X | X | X | no- | X | Δ | Δ |
| Spread-ability | X | X | X | X | grease | X | Δ | Δ |
| Consistency | 220 | 227 | 230 | 235 | — | 255 | 270 | 265 |

TABLE 3-continued

| Component | Comparative Example 1 | 2 | 3 | 4 | 5 | 6 | 7 | 8 |
|---|---|---|---|---|---|---|---|---|
| Thermal Conductivity (W/mk) | 2.5 | 26 | 2.5 | 2.6 | — | 2.5 | 2.6 | 2.5 |

What is claimed is:

1. A silicone grease composition comprising:

(A) 50 to 95 weight % of a mixture of an aluminum nitride powder α having an average particle size of 0.5 to 5 μm and an aluminum nitride powder β having an average particle size of 6 to 20 μm, wherein the aluminum nitride powders α and β are mixed so that the α/(α+β) ratio by weight is from 0.1 to 0.9 and the average particle size after mixing is from 1 to 10 μm, (B) 5 to 15 weight % of organopolysiloxanes having a viscosity of from 50 to 50,000 cs at 25° C. and represented by formula $R^1_aSiO_{(4-a)/2}$ , wherein $R^1$ represents at least one group selected from saturated or unsaturated univalent hydrocarbon groups containing 1 to 18 carbon atoms and $1.8 \leqq a \leqq 2.2$, and (C) 0 to 35 weight % of at least one inorganic compound powder having an average particle size of 0.5 to 100 μm selected from the group consisting of zinc oxide, alumina, boron nitride and silicon carbide powders.

2. A silicone grease composition according to claim 1, wherein said mixture of aluminum nitride powders α and β has a specific surface area of from 0.1 to 20 $m^2/g$.

3. A silicone grease composition according to claim 1, wherein the saturated hydrocarbon groups are methyl groups and alkyl groups having 6 to 14 carbon atoms and the unsaturated hydrocarbon groups are phenyl groups.

4. A silicone grease composition according to claim 1, wherein each of the aluminum nitride powders α and β has the surface rendered hydrophobic by treatment with an organosilane, an organopolysiloxane or a fluorine-containing organic compound.

5. The silicone grease composition according to claim 1, wherein the aluminum nitride powder α has an average particle size of 1 to 3 μm.

6. The silicone grease composition according to claim 1, wherein the aluminum nitride powder β has an average particle size of 7 to 15 μm.

7. The silicone grease composition according to claim 1, average particle size of the α and β aluminum nitride powders, after mixing, is from 2 to 5 μm.

8. The silicone grease composition according to claim 1, wherein the α/(α+β) ratio by weight is from 0.3 to 0.7.

9. The silicone grease composition according to claim 1, wherein the weight % of said component (A) is from 60 to 90.

10. The silicone grease composition according to claim 2, wherein said specific surface area is from 1 to 10 $m^2/g$.

11. The silicone grease composition according to claim 10, wherein said specific surface area is from 2–5 $m^2/g$.

12. The silicone grease composition according to claim 1, wherein $1.9 \leqq a \leqq 2.1$.

13. The silicone grease composition according to claim 1, wherein said organopolysiloxanes have a viscosity of 100 to 10,000 cs at 25 ° C.

14. The silicone grease composition according to claim 1, wherein the weight % of said component (B) is 7 to 13.

15. The silicone grease composition according to claim 1, wherein the weight % of said component (C) is at most 30.

16. The silicone grease composition according to claim 1, wherein the weight % of said component (C) is 0 to 25.

17. The silicone grease composition of claim 1, which contains at least some of compound (C).

* * * * *